US007528802B2

(12) United States Patent
Kim et al.

(10) Patent No.: US 7,528,802 B2
(45) Date of Patent: May 5, 2009

(54) DRIVING METHOD OF PLASMA DISPLAY PANEL

(75) Inventors: Jin-Sung Kim, Suwon-si (KR); Jin-Ho Yang, Suwon-si (KR); Tae-Seong Kim, Suwon-si (KR); Seung-Hun Chae, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 715 days.

(21) Appl. No.: 11/123,785

(22) Filed: May 6, 2005

(65) Prior Publication Data

US 2005/0253781 A1 Nov. 17, 2005

(30) Foreign Application Priority Data

May 11, 2004 (KR) ..... 10-2004-0032965
Jun. 30, 2004 (KR) ..... 10-2004-0050892

(51) Int. Cl.
*G09G 3/28* (2006.01)

(52) U.S. Cl. ..... 345/60; 345/66; 345/67

(58) Field of Classification Search ..... 345/60, 345/66–67
See application file for complete search history.

(56) References Cited

U.S. PATENT DOCUMENTS 6,356,261 B1 * 3/2002 Kim ..... 345/209
2002/0180665 A1 * 12/2002 Awamoto et al. ..... 345/60
2004/0001036 A1 * 1/2004 Takayama et al. ..... 345/62
2004/0217924 A1 * 11/2004 Jeong ..... 345/60
2005/0190120 A1 * 9/2005 Yoo ..... 345/60
2005/0225509 A1 * 10/2005 Choi et al. ..... 345/60
2006/0114178 A1 * 6/2006 Yang et al. ..... 345/60
2008/0136749 A1 * 6/2008 Lee ..... 345/67

FOREIGN PATENT DOCUMENTS

CN 1343965 A 4/2002
CN 1434967 A 8/2003
JP 2002-202753 A 7/2002
JP 2003-157042 A 5/2003
JP 2004-037624 2/2004

* cited by examiner

*Primary Examiner*—Bipin Shalwala
*Assistant Examiner*—Phillip Lee
(74) *Attorney, Agent, or Firm*—Christie, Parker & Hale, LLP

(57) ABSTRACT

A method for driving a plasma display panel. The plasma display panel includes a plurality of Y electrodes, a plurality of X electrodes, and a plurality of address electrodes. The Y electrodes are divided into a plurality of groups according to an order for scanning the Y electrodes and scan voltages are established to be varied for different groups when the scan voltages are sequentially applied to the Y electrodes. A period for gradually reducing a voltage at the Y electrodes and a bias voltage at the X electrodes is further included when the scan voltages are applied to the first Y electrode of each group of Y electrodes.

24 Claims, 6 Drawing Sheets

DRIVING METHOD OF PLASMA DISPLAY PANEL

CROSS REFERENCE TO RELATED APPLICATION

This application claims priority to and the benefit of Korean Patent Application Nos. 10-2004-0032965 and 10-2004-0050892 filed on May 11, 2004 and Jun. 30, 2004, respectively, in the Korean Intellectual Property Office, the entire disclosures of both of which are incorporated herein by reference.

BACKGROUND OF THE INVENTION

1. Field of the Invention

The present invention relates to a driving method of a plasma display panel.

2. Discussion of the Related Art

The plasma display panel (PDP) has been receiving substantial attention since the PDP has higher resolution, a higher rate of emission efficiency, and a wider view angle in comparison to other flat panel displays. The PDP is a flat panel display for showing characters or images using plasma generated by gas discharge, and includes more than hundreds of thousands to millions of pixels in a matrix format, in which the number of pixels are determined by the size of the PDP. With reference to FIG. 1, a configuration of the PDP will be described.

FIG. 1 shows a partial perspective view of the PDP.

As shown in FIG. 1, the PDP includes two substrates 1 and 6 that face each other with a gap therebetween. Pairs of scan electrodes 4 and sustain electrodes 5 are formed in parallel on the first glass substrate 1, and the scan electrodes 4 and the sustain electrodes 5 are covered with a dielectric layer 2 and a protection film 3. A plurality of address electrodes 8 are formed on the second glass substrate 6, and the address electrodes 8 are covered with an insulator layer 7. Barrier ribs 9 are formed in parallel with the address electrodes 8 on the insulator layer 7 between the address electrodes 8, and phosphors 10 are formed on the surface of the insulator layer 7 and on both sides of the barrier ribs 9. The glass substrates 1 and 6 are provided facing each other with discharge spaces 11 between the glass substrates 1 and 6 so that the scan electrodes 4 and the sustain electrodes 5 can cross the address electrodes 8. A discharge space 11 between the address electrode 8 and a crossing part of a pair of the scan electrode 4 and the sustain electrode 5 forms a discharge cell 12.

The electrodes of the PDP have an m×n matrix format. The address electrodes A1 to Am are arranged in the column direction, and n scan electrodes Y1 to Yn and sustain electrodes X1 to Xn are arranged in the row direction. The PDP operates with a frame divided into a plurality of subfields, and gray scales are represented by a combination of the subfields. Conventionally, each subfield has a reset period, an address period, and a sustain period.

Wall charges formed by a previous sustain-discharge are eliminated, and wall charges are established for performing a next address discharge properly in the reset period. Cells that are turned on (i.e., addressed cells) and cells that are turned off on the panel are selected, and wall charges are accumulated to the cells that are turned on in the address period. A sustain-discharge for substantially displaying images on the addressed cells is performed in the sustain period.

The term "wall charges" as used herein refer to charges that are formed on a wall of discharge cells neighboring each electrode and accumulated to electrodes. Although the wall charges do not actually touch the electrodes, it will be described that the wall charges are "generated," "formed," or "accumulated" thereon. Also, a wall voltage represents a potential difference formed on the wall of the discharge cells by the wall charges.

FIG. 2 shows conventional driving waveforms.

As shown in FIG. 2, a voltage at the scan electrode (i.e., Y electrode) is reduced to a voltage of VscL while a wall voltage between the scan electrode and the sustain electrode is maintained at a voltage which approximates a discharge firing voltage at the end of the reset period. In the address period, a scan pulse which has the voltage of VscL as a low peak voltage and a voltage of VscH as a high peak voltage is applied to the scan electrode in sequence, and a data pulse is applied to the address electrode at the same time so as to generate an address discharge.

The address discharge is determined by a density of priming particles and the wall voltage generated in the discharge space. For the first scan electrodes on the lower part of the panel, it takes longer to apply the scan pulse after the reset discharge is generated, and therefore the density of the priming particles is reduced. A voltage in the discharge space is gradually reduced and the wall voltage is eliminated on the lower part of the panel. Accordingly, an address margin is problematically reduced because it takes longer to discharge on the lower part of the panel than on the upper part of the panel.

SUMMARY OF THE INVENTION

In an exemplary embodiment according to the present invention, a driving method of a plasma display panel for increasing a discharge margin in an address period is provided.

Additional features of the invention will be set forth in the description which follows, and in part will be apparent from the description, or may be learned by practice of the invention.

In an exemplary embodiment of the present invention, a driving method of a plasma display panel including a plurality of first electrodes, a plurality of second electrodes, and address electrodes, is provided.

According to the method, the first electrodes are divided into a plurality of groups having a first group and a second group.

In an address period, a) a scan pulse having a first voltage is sequentially applied to the first electrodes of the first group; b) a voltage at the first electrodes is gradually reduced from the first voltage to a second voltage; and c) a scan pulse having a third voltage, which is less than the first voltage, is sequentially applied to the first electrodes of the second group.

The plurality of groups may further include a third group.

According to the method, after c), d) the voltage at the first electrodes may gradually be reduced from the third voltage to a fourth voltage; and e) a scan pulse having a fifth voltage, which is less than the third voltage, may sequentially be applied to the first electrodes of the third group.

In another exemplary embodiment of the present invention, a method for driving a plasma display panel is provided.

According to the method, in an address period of a first subfield, a plurality of first electrodes are divided into a plurality of groups having a first group and a second group, and a) a scan pulse having a first voltage is sequentially applied to the first electrodes of the first group; b) a voltage at the first electrodes is gradually reduced from the first voltage to a second voltage; and c) a scan pulse having a third voltage, which is less than the first voltage, is sequentially applied to the first electrodes of the second group.

In an address period of a second subfield, the plurality of first electrodes are divided into a plurality of groups having a third group and a fourth group, and d) the scan pulse having the first voltage is sequentially applied to the first electrodes of the third group; e) the voltage at the first electrodes is gradually reduced from the first voltage to a fourth voltage; and f) a scan pulse having a fifth voltage, which is less than the first voltage, is sequentially applied to the first electrodes of the fourth group.

In yet another exemplary embodiment of the present invention, a driving method of a plasma display panel is provided.

According to the method, a plurality of first electrodes are divided into a plurality of groups having a first group and a second group.

In an address period, a) a scan pulse having a second voltage is sequentially applied to the first electrodes of the first group while a voltage at the second electrodes is biased to a first voltage; b) a voltage at the first electrodes is gradually reduced to a third voltage; and c) a scan pulse having fifth voltage, which is less than the second voltage, is sequentially applied to the first electrodes of the second group while the voltage at the second electrodes is biased to a fourth voltage, which is less than the first voltage.

In b), the voltage at the second electrodes may be biased to the fourth voltage, and the voltage at the first electrodes may gradually be reduced from the second voltage to the third voltage.

The plurality of groups may include a third group. After c), d) the voltage at the first electrodes may gradually be reduced to a seventh voltage; and e) a scan pulse having a eighth voltage, which is less than the fifth voltage, may sequentially be applied to the first electrodes of the third group while the voltage at the second electrodes is biased to a sixth voltage, which is less than the fourth voltage.

In yet another exemplary embodiment of the present invention, a driving method of a plasma display panel is provided.

According to the method, a plurality of first electrodes are divided into a plurality of groups having a first group, a second group, and a third group.

In an address period, a) a scan pulse having a second voltage is sequentially applied to the first electrodes of the first group while a voltage at the second electrodes is biased to a first voltage; b) a voltage at the first electrodes is gradually reduced to a third voltage while the voltage at the second electrodes is biased to the first voltage; c) a scan pulse having a fourth voltage, which is less than the second voltage, is sequentially applied to the first electrodes of the second group; d) the voltage at the first electrodes is gradually reduced to a fifth voltage; and e) a scan pulse having a seventh voltage, which is less than the fourth voltage, is sequentially applied to the first electrodes of the third group while the voltage at the second electrodes is biased to a sixth voltage, which is less than the first voltage.

BRIEF DESCRIPTION OF THE DRAWINGS

The accompanying drawings, together with the specification, illustrate certain exemplary embodiments of the present invention, and, together with the description, serve to explain the principles of the present invention.

DETAILED DESCRIPTION

Figure 1:
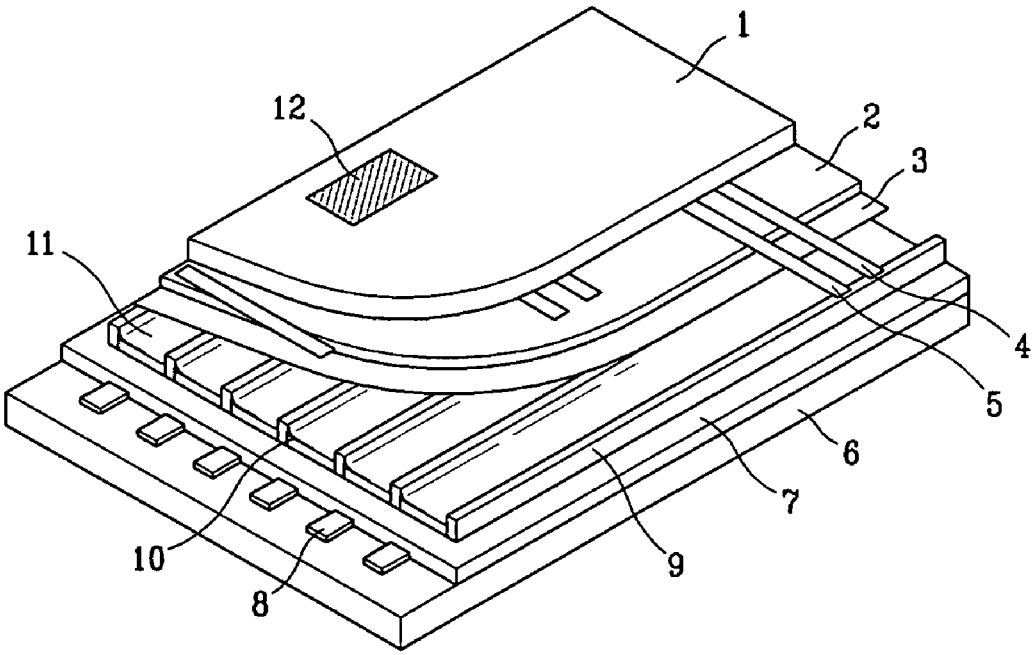
FIG. 1 (Prior art)
FIG. 1 shows a partial perspective view of a plasma display panel (PDP).
Figure 2:
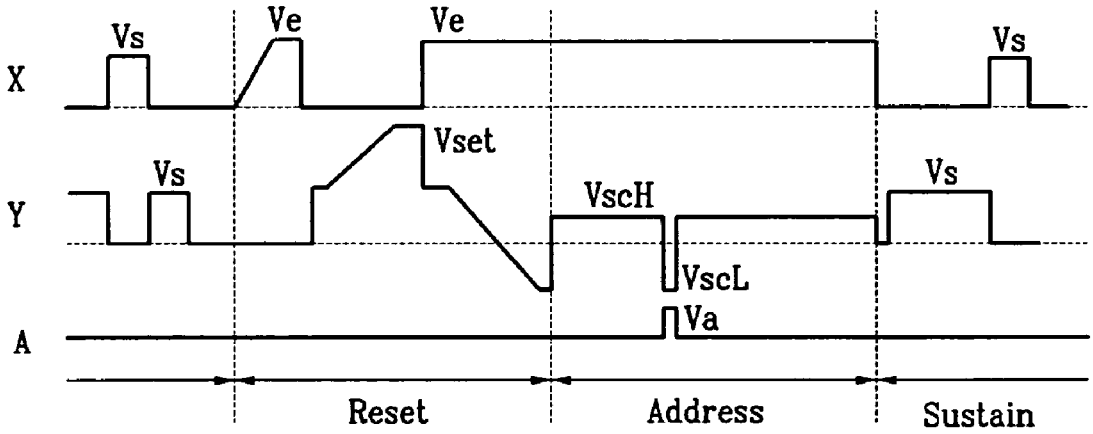
FIG. 2 (Prior art)
FIG. 2 shows driving waveforms of a conventional PDP.

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

There may be parts shown in the drawings, or parts not shown in the drawings, that are not discussed in the specification as they are not essential to a complete understanding of the invention. Further, like elements are designated by like reference numerals.

Exemplary embodiments of the present invention will now be described in detail with a reference to the drawings.

Figure 3:
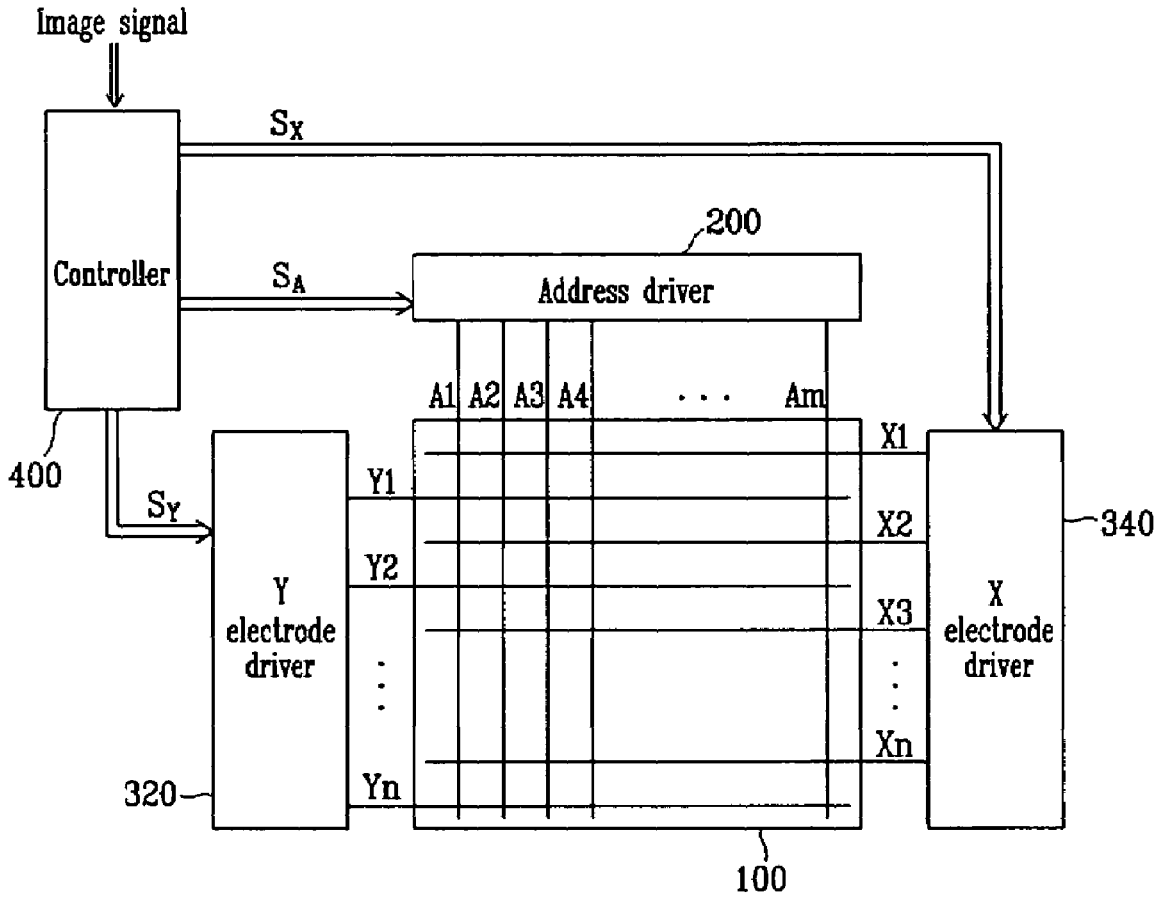
FIG. 3 is a block diagram of a PDP according to an exemplary embodiment of the present invention.

FIG. 3 is a block diagram of a PDP according to an exemplary embodiment of the present invention.

As shown in FIG. 3, the PDP according to the exemplary embodiment of the present invention includes a plasma panel 100, an address driver 200, a Y electrode driver 320, an X electrode driver 340, and a controller 400.

The plasma panel 100 includes a plurality of address electrodes A1 to Am arranged in the column direction, and first electrodes Y1 to Yn (hereinafter, referred to as Y electrodes) and second electrodes X1 to Xn (hereinafter, referred to as X electrodes) arranged in the row direction.

The address driver 200 receives an address driving control signal $S_A$ from the controller 400 and applies a display data signal for selecting discharge cells to be displayed to each address electrode.

The Y electrode driver 320 and the X electrode driver 340 respectively receive a Y electrode driving signal $S_Y$ and an X electrode driving signal $S_X$ from the controller 400, and apply the signals to the X electrodes and the Y electrodes.

The controller 400 receives an external image signal, generates the address driving control signal $S_A$, the Y electrode driving signal $S_Y$, and the X electrode driving signal $S_X$ and respectively transmits them to the address driver 200, the Y electrode driver 320, and the X electrode driver 340.

Figure 4:
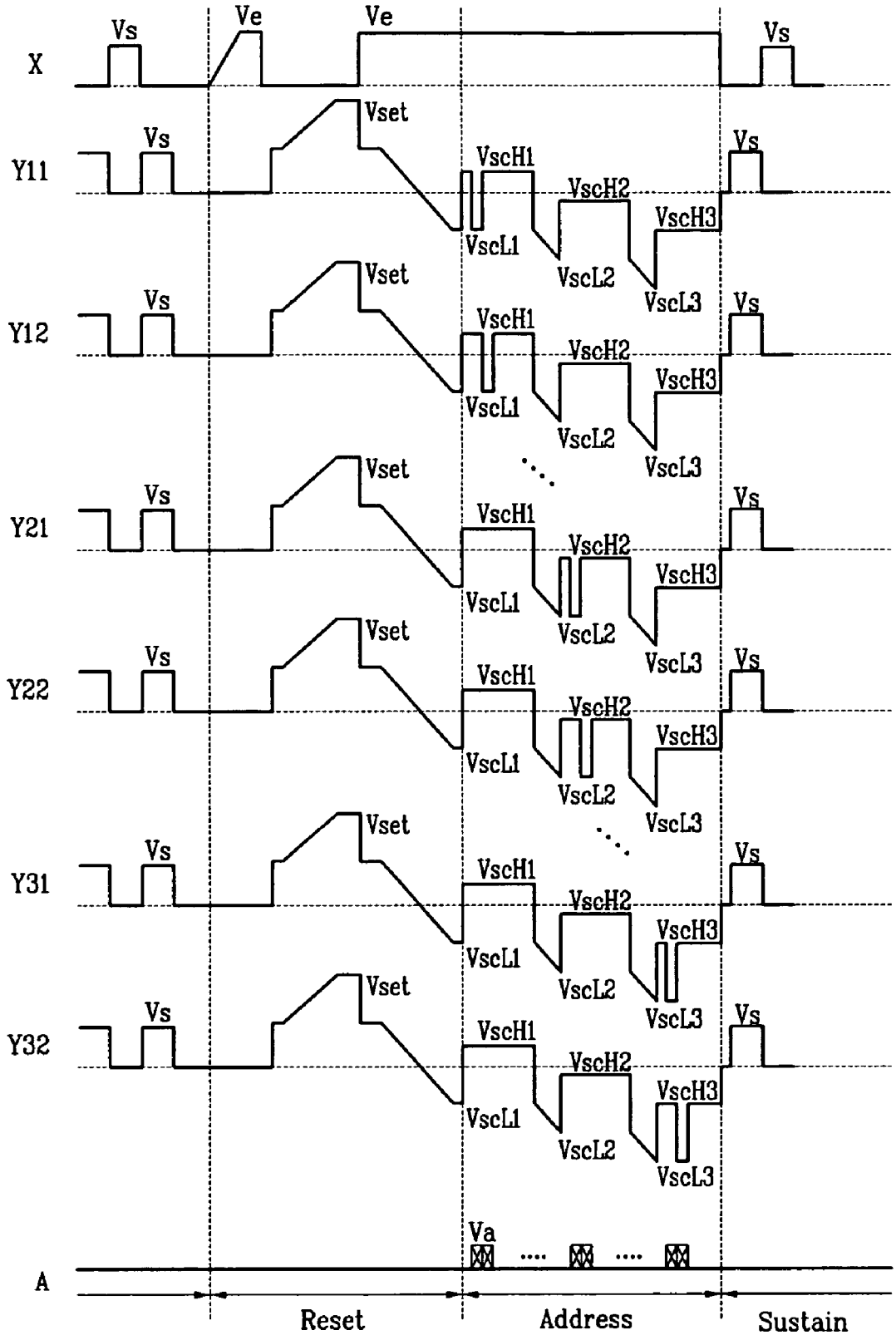
FIG. 4 shows driving waveforms applied to a PDP according to a first exemplary embodiment of the present invention.

FIG. 4 shows a diagram for representing driving waveforms applied to a PDP according to a first exemplary embodiment of the present invention.

As shown in FIG. 4, according to the first exemplary embodiment of the present invention, the Y electrodes are divided into a plurality of groups according to an order for scanning the Y electrodes, and different scan voltages are established for different groups when scan voltages are applied to the Y electrodes in sequence. Also, a period for reducing the voltage at the Y electrodes in a manner similar to that of the falling ramp reset period is included in the address period before the scan voltage is applied to the first Y electrode of each group except for the first group (on which the scan voltage is applied after the falling ramp period of the reset period). It is illustrated that the Y electrodes are divided into three groups (i.e., first, second, and third scan groups) for convenience of description in FIG. 4.

After a voltage at the Y electrodes is reduced to a voltage of VscL1 in a falling reset period, a scan pulse having the voltage of VscL1 is sequentially applied to a first scan group while a voltage of VscH1 is applied to the Y electrodes in the address period. At this time, the voltage at the Y electrodes is VscL1 when an address operation of the first scan group is finished.

In discharge cells including the Y electrodes of the second scan group, the address discharge may not be stably generated by a scan voltage pulse having the voltage of VscL1 because the wall voltage is eliminated in these discharge cells while the scan voltage pulse is applied to the first scan group. Accordingly, the voltage at the Y electrodes is reduced from the voltage of VscL1 to a voltage of VscL2 before the second scan group is addressed. A weak discharge is generated between the X electrodes and the Y electrodes and the wall charges are eliminated in a manner similar to that of applying a falling ramp waveform in the reset period. Therefore, a state of the discharge cells change so as to make it easier to perform the address-discharge in them. Therefore, the address discharge is stably generated when the scan pulse having the voltage of VscL2 is sequentially applied to the Y electrodes of the second scan group in this state. At this time, a voltage which is applied to scan lines that are not selected is reduced to a voltage of VscH2 for the purpose of establishing an address condition of the second scan group to correspond to an address condition of the first scan group.

The scan voltage pulse is sequentially applied to the second scan group, the voltage of the Y electrodes is gradually reduced from the voltage of VscL2 to a voltage of VscL3 before the scan voltage pulse is applied to the third scan group for the purpose of increasing address discharge efficiency of the third scan group, and the scan voltage pulse having the voltage of VscL3 is sequentially applied to the Y electrodes of the third scan group. The voltage difference between the voltages of VscL2 and VscL3, may, for example, be substantially the same as the voltage difference between the voltages of VscL1 and VscL2.

According to the first exemplary embodiment of the present invention, while a wall charge loss of the address electrodes on a lower part of the panel is compensated by further including a period for gradually reducing the voltage at the Y electrodes before the scan voltage is applied to the first Y electrode of each group except for the first group, a voltage difference between the X electrode and the Y electrode is greater in the lower part of the panel because the voltage at the X electrode is biased to a predetermined voltage in the address period. Accordingly, a discharge can be generated in non-addressed cells in the sustain period because a discharge can be generated between the X electrode and the Y electrode in the discharge cells that are not selected in the address period.

Accordingly, in a second exemplary embodiment of the present invention, a bias voltage at the X electrodes is gradually reduced and the voltage at the Y electrodes is reduced for each group in the address period. The second exemplary embodiment of the present invention will be described with a reference to FIG. 5.

Figure 5:
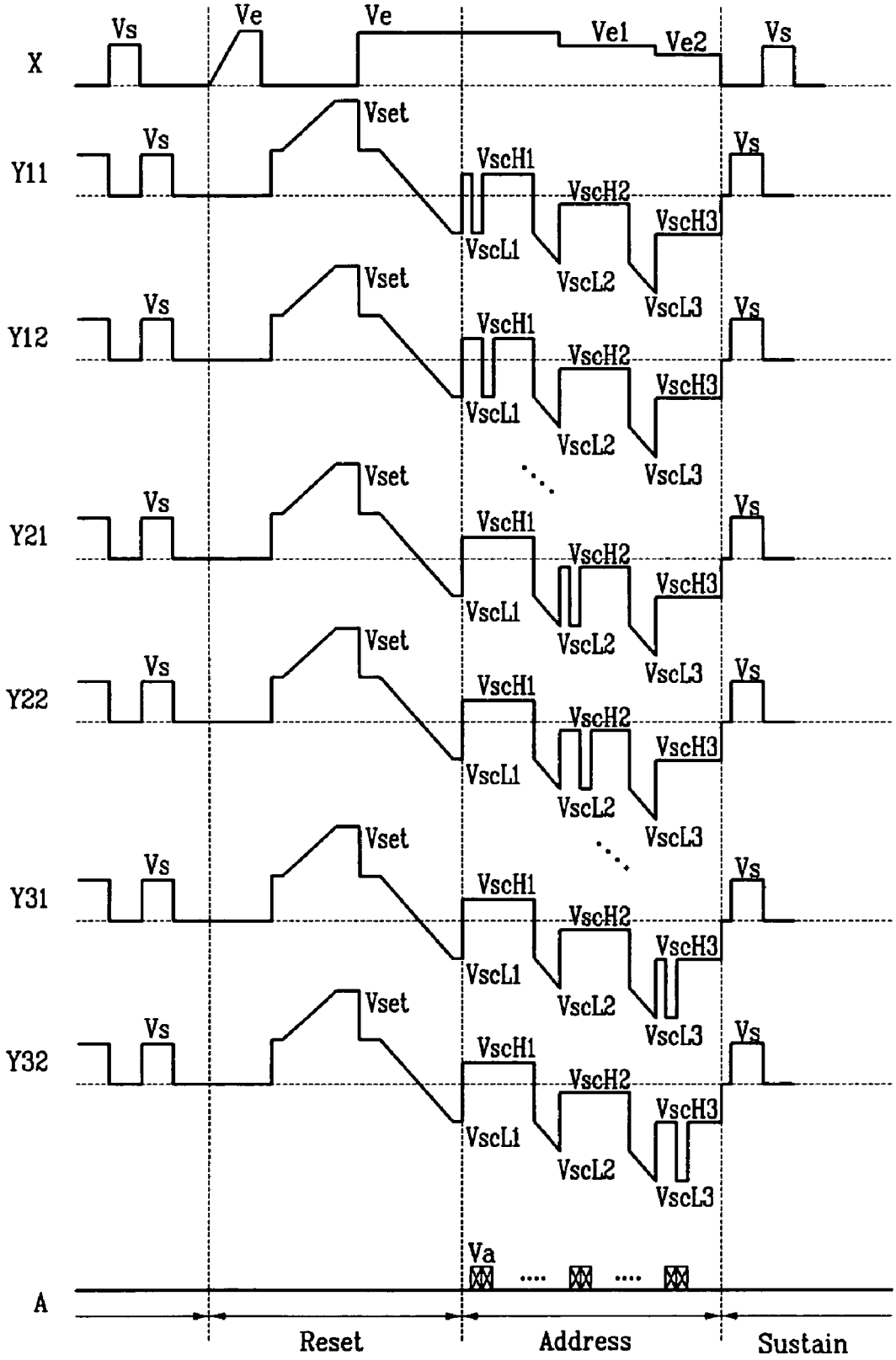
FIG. 5 shows driving waveforms applied to a PDP according to a second exemplary embodiment of the present invention.

FIG. 5 shows driving waveforms of a PDP according to a second exemplary embodiment of the present invention.

As shown in FIG. 5, the driving waveforms according to the second exemplary embodiment of the present invention are substantially the same as those of the first exemplary embodiment except for establishing the voltages at the X electrode for each group to be varied (i.e., different from one another) in the address period.

The Y electrodes are divided into a plurality of groups according to an order for applying the scan pulse, and the scan pulse voltage is established to be varied for each group just like in the case of the first exemplary embodiment of the present invention. In addition, the X electrodes are divided into a plurality of groups to correspond to the respective groups of the Y electrodes in the second exemplary embodiment of the present invention. The voltage at the X electrodes of each group is reduced and the voltage at the Y electrodes is reduced at the same time when the scan voltage is applied to the first Y electrode of each group in the address period.

That is, the scan pulse having the voltage of VscL1 is sequentially applied to the first scan group while the voltage of VscH1 is applied to the Y electrodes in the address period, and the X electrode group corresponding to the first scan group is biased to a voltage of Ve.

When the address operation of the first scan group is finished, the voltage at the Y electrodes is gradually reduced from the voltage of VscL1 to the voltage of VscL2 before the second group is addressed. At this time, the bias voltage of the X electrode group corresponding to the second scan group is reduced to a voltage of Ve1 which is less than the voltage of Ve. No erroneous discharge in the sustain period is generated because the increase in the voltage difference between the X electrodes and the Y electrodes is compensated as the voltage at the second scan group is reduced.

The scan pulse having the voltage of VscL2 is sequentially applied to the second scan group and the address operation is finished, and the voltage at the Y electrodes is gradually reduced from the voltage of VscL2 to the voltage of VscL3 before the scan voltage pulse is applied to the third scan group. Also, the bias voltage at the X electrodes corresponding to the third scan group is reduced to a voltage of Ve2 which is less than the voltage of Ve1, and therefore the increase of the voltage difference between the X electrode and the Y electrode is compensated.

The voltage difference between the voltage of Ve applied to the X electrodes and the voltage of VscL1 applied to the Y electrodes may be substantially the same as or different from a voltage difference between the voltage of Ve1 applied to the X electrodes and the voltage of VscL2 applied to the Y electrodes. Further, the voltage difference between the voltage of Ve2 applied to the X electrodes and the voltage of VscL3 applied to the Y electrodes may be substantially the same as or different from the voltage difference between the voltage of Ve1 applied to the X electrodes and the voltage of VscL2 applied to the Y electrodes and/or the voltage difference between the voltage of Ve applied to the X electrodes and the voltage of VscL1 applied to the Y electrodes.

Figure 6:
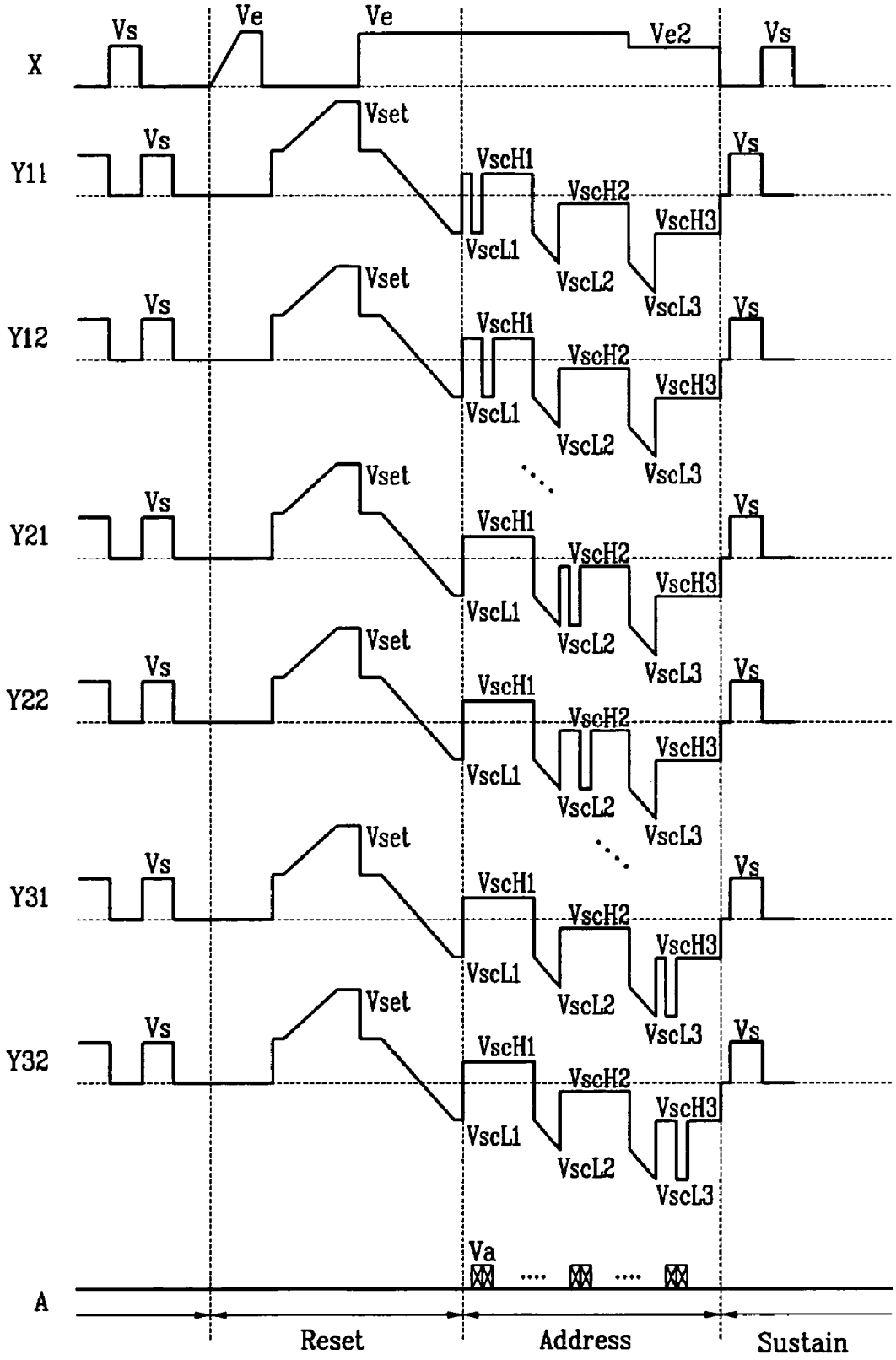
FIG. 6 shows driving waveforms applied to a PDP according to a third exemplary embodiment of the present invention.

The voltages of the X electrode groups corresponding to the respective scan groups are established to be varied in the second exemplary embodiment of the present invention. However, in a third exemplary embodiment of the present invention, the bias voltage at the X electrode is maintained at a predetermined voltage without reducing the bias voltage even though the voltage at the Y electrodes is reduced when the voltage difference between the X electrode and the Y electrode is maintained at a voltage which would not generate an erroneous discharge in the sustain period. In FIG. 6, the bias voltage at the X electrodes is maintained at the voltage of Ve while the first scan group and the second scan group are addressed, and the bias voltage at the X electrodes is reduced to the voltage of Ve2 when the third scan group is addressed.

Accordingly, the number of power sources can be reduced because voltage levels of the bias voltage that are applied at the X electrodes are reduced.

In FIG. 6, a voltage difference between the voltage of Ve2 applied to the X electrodes and the voltage of VscL3 applied to the Y electrodes may be substantially the same as or different from a voltage difference between the voltage of Ve applied to the X electrodes and the voltage of VscL1 applied to the Y electrodes. Further, the voltage difference between the voltage of Ve2 applied to the X electrodes and the voltage of VscL3 applied to the Y electrodes may be substantially the same as or different from a voltage difference between the voltage of Ve applied to the X electrodes and the voltage of VscL2 applied to the Y electrodes.

Figure 7:
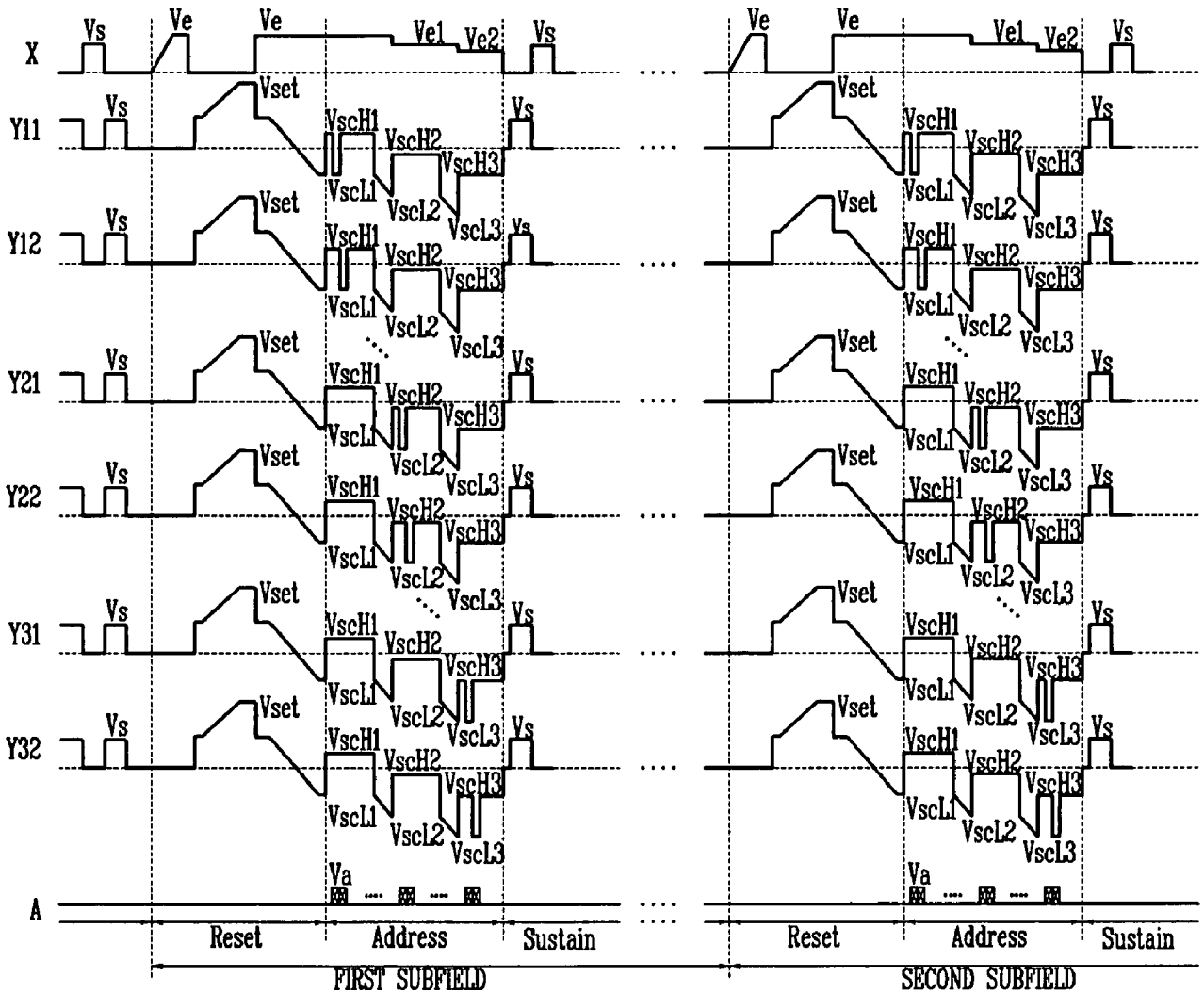
FIG. 7 shows driving waveforms of FIG. 5 that are applied to a PDP during first and second subfields.

While FIGS. 4-6 each show driving waveforms of a single subfield, those skilled in the art would recognize that the driving waveforms of other subfields can be substantially the same as the respective driving waveforms depicted in FIG. 4-6. By way of example, FIG. 7 shows a driving waveform first and second subfields, each of which is substantially the same as the subfield of FIG. 5.

While the scan voltage is substantially the same as a voltage prior to applying the scan voltage pulse to each group in the first to third exemplary embodiments, the two voltages may be established to be varied (i.e., different) from each other.

Also, a scan voltage difference between the respective scan groups, that is, a voltage difference between the voltage of VcsL1 and the voltage of VscL2 and a voltage difference between the voltage of VscL2 and the voltage of VscL3 can be established to be the same or varied (i.e., different) from each other.

The voltage differences can be established to be the same or varied for the respective subfields and the scan groups can be established to be same or varied for the respective subfields. By way of example, the Y electrodes in other subfields may be grouped into scan groups that are same or different from the first (Y electrodes Y11, Y12 . . . ), second (Y electrodes Y21, Y22 . . . ) and third scan groups (Y electrodes Y31, Y32 . . . ) depicted in FIGS. 4-6.

According to the present invention as described above, the Y electrodes are divided into a plurality of groups according to the scanning order and the scan voltages for the respective groups are established to be varied when the scan voltage is sequentially applied to the Y electrodes. The period for gradually reducing the voltage at the Y electrode is further included before the scan voltage is applied to the first Y electrode of each group except for the first group, and the discharge cells prior to applying the scan voltage recover a state after an reset operation, and therefore the address discharge efficiency is increased.

Also, the bias voltage at the X electrodes may be reduced when the voltage at the Y electrodes is reduced in the address period, and the voltage difference between the X electrodes and the Y electrodes is compensated, and therefore the erroneous discharge is not generated in the sustain period.

While certain exemplary embodiments of the present invention have been described above, it will be apparent to those skilled in the art that various modifications and variations can be made to the described embodiments without departing from the spirit or scope of the invention. Thus, it is intended that the present invention covers the modifications and variations of this invention that are within the scope of the appended claims and their equivalents.

What is claimed is:

1. A method for driving a plasma display panel including a plurality of first electrodes, a plurality of second electrodes, and a plurality of address electrodes, the first electrodes being divided into a plurality of groups comprising a first group and a second group, the method comprising, in an address period, a) sequentially applying a scan pulse having a first voltage to the first electrodes of the first group;

b) gradually reducing a voltage at the first electrodes from the first voltage to a second voltage; and c) sequentially applying a scan pulse having a third voltage, which is less than the first voltage, to the first electrodes of the second group.

2. The method of claim 1, wherein the second voltage is substantially the same as the third voltage.

3. The method of claim 1, wherein the plurality of groups further comprise a third group, the method further comprising, after c), d) gradually reducing the voltage at the first electrodes from the third voltage to a fourth voltage; and e) sequentially applying a scan pulse having a fifth voltage, which is less than the third voltage, to the first electrodes of the third group.

4. The method of claim 3, wherein the fourth voltage is substantially the same as the fifth voltage.

5. The method of claim 3, wherein a voltage difference between the first voltage and the third voltage is substantially the same as a voltage difference between the third voltage and the fifth voltage.

6. The method of claim 3, wherein a voltage difference between the first voltage and the second voltage is substantially the same as a voltage difference between the third voltage and the fourth voltage.

7. A method for driving a plasma display panel including a plurality of first electrodes, a plurality of second electrodes, and a plurality of address electrodes, the method comprising:

in an address period of a first subfield, when a plurality of first electrodes are divided into a plurality of groups comprising a first group and a second group, a) sequentially applying a scan pulse having a first voltage to the first electrodes of the first group, b) gradually reducing a voltage at the first electrodes from the first voltage to a second voltage, and c) sequentially applying a scan pulse having a third voltage, which is less than the first voltage, to the first electrodes of the second group; and in an address period of a second subfield, when the plurality of first electrodes are divided into a plurality of groups having a third group and a fourth group, d) sequentially applying the scan pulse having the first voltage to the first electrodes of the third group, e) gradually reducing the voltage at the first electrodes from the first voltage to a fourth voltage, and f) sequentially applying a scan pulse having a fifth voltage, which is less than the first voltage, to the first electrodes of the fourth group.

8. The method of claim 7, wherein the first electrodes of the first group and the second group are different from the first electrodes of the third group and the fourth group.

9. The method of claim 7, wherein the first electrodes of the first group and the second group are the same as the first electrodes of the third group and the fourth group.

10. The method of claim 7, wherein a voltage difference between the first voltage and the third voltage is substantially the same as a voltage difference between the first voltage and the fifth voltage.

11. The method of claim 7, wherein the second voltage is substantially the same as the third voltage and the fourth voltage is substantially the same as the fifth voltage.

12. A method for driving a plasma display panel including a plurality of first electrodes, a plurality of second electrodes, and a plurality of address electrodes, the method comprising, when a plurality of first electrodes are divided into a plurality of groups comprising a first group and a second group, in an address period, a) sequentially applying a scan pulse having a second voltage to the first electrodes of the first group while a voltage at the second electrodes is biased to a first voltage;

b) gradually reducing a voltage at the first electrodes to a third voltage; and c) sequentially applying a scan pulse having a fifth voltage, which is less than the second voltage, to the first electrodes of the second group while the voltage at the second electrodes is biased to a fourth voltage, which is less than the first voltage.

13. The method of claim 12, wherein, in b), the voltage at the second electrodes is biased to the fourth voltage.

14. The method of claim 12, wherein, in b), the voltage at the first electrodes is gradually reduced from the second voltage to the third voltage.

15. The method of claim 12, wherein the third voltage is substantially the same as the fifth voltage.

16. The method of claim 12, wherein a voltage difference between the first voltage and the second voltage is substantially the same as a voltage difference between the fourth voltage and the fifth voltage.

17. The method of claim 12, wherein the plurality of groups further comprise a third group, the method further comprising, after c), d) gradually reducing the voltage at the first electrodes to a seventh voltage;

e) sequentially applying a scan pulse having a eighth voltage, which is less than the fifth voltage, to the first electrodes of the third group while the voltage at the second electrodes is biased to a sixth voltage, which is less than the fourth voltage.

18. The method of claim 17, wherein the seventh voltage is substantially the same as the eighth voltage.

19. The method of claim 17, wherein a voltage difference between the first voltage and the second voltage is substantially the same as a voltage difference between the sixth voltage and the eighth voltage.

20. A method for driving a plasma display panel including a plurality of first electrodes, a plurality of second electrodes, and a plurality of address electrodes, the method comprising, when the plurality of first electrodes are divided into a plurality of groups comprising a first group, a second group, and a third group, in an address period, a) sequentially applying a scan pulse having a second voltage to the first electrodes of the first group while a voltage at the second electrodes is biased to a first voltage;

b) gradually reducing a voltage at the first electrodes to a third voltage while the voltage at the second electrodes is biased to the first voltage;

c) sequentially applying a scan pulse having a fourth voltage, which is less than the second voltage, to the first electrodes of the second group;

d) gradually reducing the voltage at the first electrodes to a fifth voltage; and e) sequentially applying a scan pulse having a seventh voltage, which is less than the fourth voltage, to the first electrodes of the third group while the voltage at the second electrodes is biased to a sixth voltage, which is less than the first voltage.

21. The method of claim 20, wherein, in d), the voltage at the second electrodes is biased to the sixth voltage.

22. The method of claim 20, wherein the voltage at the first electrodes is gradually reduced from the second voltage to the third voltage in b), and the voltage at the first electrodes is reduced from the third voltage to the fifth voltage in d).

23. The method of claim 20, wherein the third voltage is substantially the same as the fourth voltage and the fifth voltage is substantially the same as the seventh voltage.

24. The method of claim 20, wherein a voltage difference between the first voltage and the fourth voltage is substantially the same as a voltage difference between the sixth voltage and the seventh voltage.

* * * * *